US007894767B2

(12) United States Patent
Silva

(10) Patent No.: US 7,894,767 B2
(45) Date of Patent: Feb. 22, 2011

(54) METHODS AND DEVICES FOR EVALUATING PRINT QUALITY

(75) Inventor: Gary Silva, Reseda, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 748 days.

(21) Appl. No.: 11/893,841

(22) Filed: Aug. 17, 2007

(65) Prior Publication Data

US 2009/0046290 A1 Feb. 19, 2009

(51) Int. Cl.
*G03G 15/00* (2006.01)

(52) U.S. Cl. ..... 399/411; 428/323; 430/108.21

(58) Field of Classification Search ..... 399/109, 399/15

See application file for complete search history.

(56) References Cited

U.S. PATENT DOCUMENTS 5,262,231 A * 11/1993 Aoki ..... 428/323
5,500,046 A * 3/1996 Hagiwara et al. ..... 399/1
6,403,273 B1 * 6/2002 Ting et al. ..... 430/108.8
H2113 H * 1/2005 Nichols et al. ..... 523/160

* cited by examiner

*Primary Examiner*—David M Gray
*Assistant Examiner*—Roy Yi

(57) ABSTRACT

A method for evaluating print quality comprising providing a first paper; providing a second paper; providing a reference print sample; providing a test print sample; obtaining pre-rub densities of the first paper and the second paper or the reference print sample and the test print sample; providing a mechanical rub tester; rubbing the reference print sample with a first paper using the mechanical rub tester; obtaining post-rub density of the rubbed first paper or the rubbed reference print sample; rubbing the test print sample with a second paper using the mechanical rub tester; obtaining post-rub density of the rubbed second paper or the rubbed test print sample; and comparing the pre-rub and post-rub densities of the first and second papers or the rubbed reference print sample and the rubbed test print sample.

19 Claims, 8 Drawing Sheets

40

| | 42a POSITION A | 42b POSITION B | 42c POSITION C | 42d POSITION D | 42e POSITION E | 42f AVERAGE |
|---|---|---|---|---|---|---|
| 44a FIRST REFERENCE BLANK PAPER PRE-RUB | 0.044 | 0.037 | 0.036 | 0.037 | 0.040 | 0.039 |
| 44b FIRST REFERENCE BLANK PAPER POST-RUB | 0.062 | 0.042 | 0.043 | 0.044 | 0.042 | 0.047 |
| 44c SECOND TEST BLANK PAPER PRE-RUB | 0.047 | 0.041 | 0.035 | 0.035 | 0.038 | 0.039 |
| 44d SECOND TEST BLANK PAPER POST-RUB | 0.065 | 0.044 | 0.040 | 0.036 | 0.036 | 0.044 |

| | DIFFERENCE<br>AVE. POST RUB DENSITY-AVE. PRE-RUB DENSITY | % DIFFERENCE<br>$=\frac{\text{DIFFERENCE}}{\text{POST RUB}} \times 100\%$ |
|---|---|---|
| 46a FIRST REFERENCE BLANK PAPER | 0.047 - 0.039 = 0.008 | $\frac{0.008}{0.047} \times 100\% = 17\%$ (48a) |
| 46b SECOND TEST BLANK PAPER | 0.044 - 0.039 = 0.005 | $\frac{0.005}{0.044} \times 100\% = 11\%$ (48b) |

50 % DIFFERENCE TO REFERENCE = 6%

FIG. 7

50

| | POSITION A | POSITION B | POSITION C | POSITION D | POSITION E | AVERAGE |
|---|---|---|---|---|---|---|
| REFERENCE PRINT SAMPLE PRE-RUB | 1.520 | 1.475 | 1.437 | 1.438 | 1.425 | 1.459 |
| REFERENCE PRINT SAMPLE POST-RUB | 1.541 | 1.486 | 1.450 | 1.452 | 1.433 | 1.472 |
| TEST PRINT SAMPLE PRE-RUB | 1.554 | 1.556 | 1.569 | 1.576 | 1.564 | 1.564 |
| TEST PRINT SAMPLE POST-RUB | 1.542 | 1.562 | 1.543 | 1.535 | 1.548 | 1.546 |

| | DIFFERENCE<br>POST RUB DENSITY - PRE-RUB DENSITY | % DIFFERENCE<br>$= \frac{\text{DIFFERENCE}}{\text{POST RUB}} \times 100\%$ |
|---|---|---|
| REFERENCE PRINT SAMPLE | 1.472 - 1.459 = 0.013 | $\frac{0.013}{1.472} \times 100\% = 0.9\%$ |
| TEST PRINT SAMPLES | 1.546 - 1.564 = -0.018 | $\frac{-0.018}{1.546} \times 100\% = 1.2\%$ |
| | % DIFFERENCE TO REFERENCE = 0.3% | |

FIG. 8

METHODS AND DEVICES FOR EVALUATING PRINT QUALITY

CROSS REFERENCES TO RELATED APPLICATIONS

None

FIELD OF INVENTION

The present invention relates to electrophotography, particularly methods and apparatus for evaluating print quality during manufacturing or remanufacturing of printer, facsimile, and copier cartridges.

BACKGROUND

Toner and ink manufacturers and re-manufacturers evaluate print quality before releasing a new, revised, or improved product into the market. Specifically, they look for print quality features, such as uniformity, background, text quality, density, toner scatter, toner compatibility, toner fusability, and the like. Printer cartridge re-manufacturers clean, repair damaged parts, replace worn parts, and add toner. Printer cartridge re-manufacturers also often evaluate print quality to select a part they want to use in remanufacturing. For instance, printer cartridge re-manufacturers run various print quality tests to find the toner type, which when added to a cartridge would allow the cartridge to closely resemble the performance of the cartridge from an original equipment manufacturer (OEM).

Conventional methods for evaluating print quality include using an adhesive tape or using a person's finger. Test and reference prints are printed, and then an adhesive tape is adhered to each of the prints. Alternatively, a person would wipe his finger on each of the prints. The amount of toner that adheres to the adhesive tape or finger for each of the prints is then compared. It can be realized that the above conventional methods do not provide a quantitative, objective, and repeatable test method. For instance, the duration and amount of pressure being applied to the prints either by the tape or the finger is not controlled and would vary each time the test is conducted. Methods and devices for effectively evaluating print quality are desired and are addressed by the present invention.

BRIEF DESCRIPTION

The invention includes a method for evaluating print quality comprising providing a first paper; providing a second paper; providing a reference print sample; providing a test print sample; obtaining pre-rub densities of the first paper and the second paper or the reference print sample and the test print sample; providing a mechanical rub tester; rubbing the reference print sample with a first paper using the mechanical rub tester; obtaining post-rub density of the rubbed first paper or the rubbed reference print sample; rubbing the test print sample with a second paper using the mechanical rub tester; obtaining post-rub density of the rubbed second paper or the rubbed test print sample; and comparing the pre-rub and post-rub densities of the first and second papers or the rubbed reference print sample and the rubbed test print sample.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

BRIEF DESCRIPTION OF THE DRAWINGS

FIG. 7 is substantially a sample table showing a sample print quality evaluation result from the print quality evaluation method of the present invention.

FIG. 8 is substantially sample table showing a sample print quality evaluation result from the print quality evaluation method of the present invention.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Before describing one of the methods, the order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
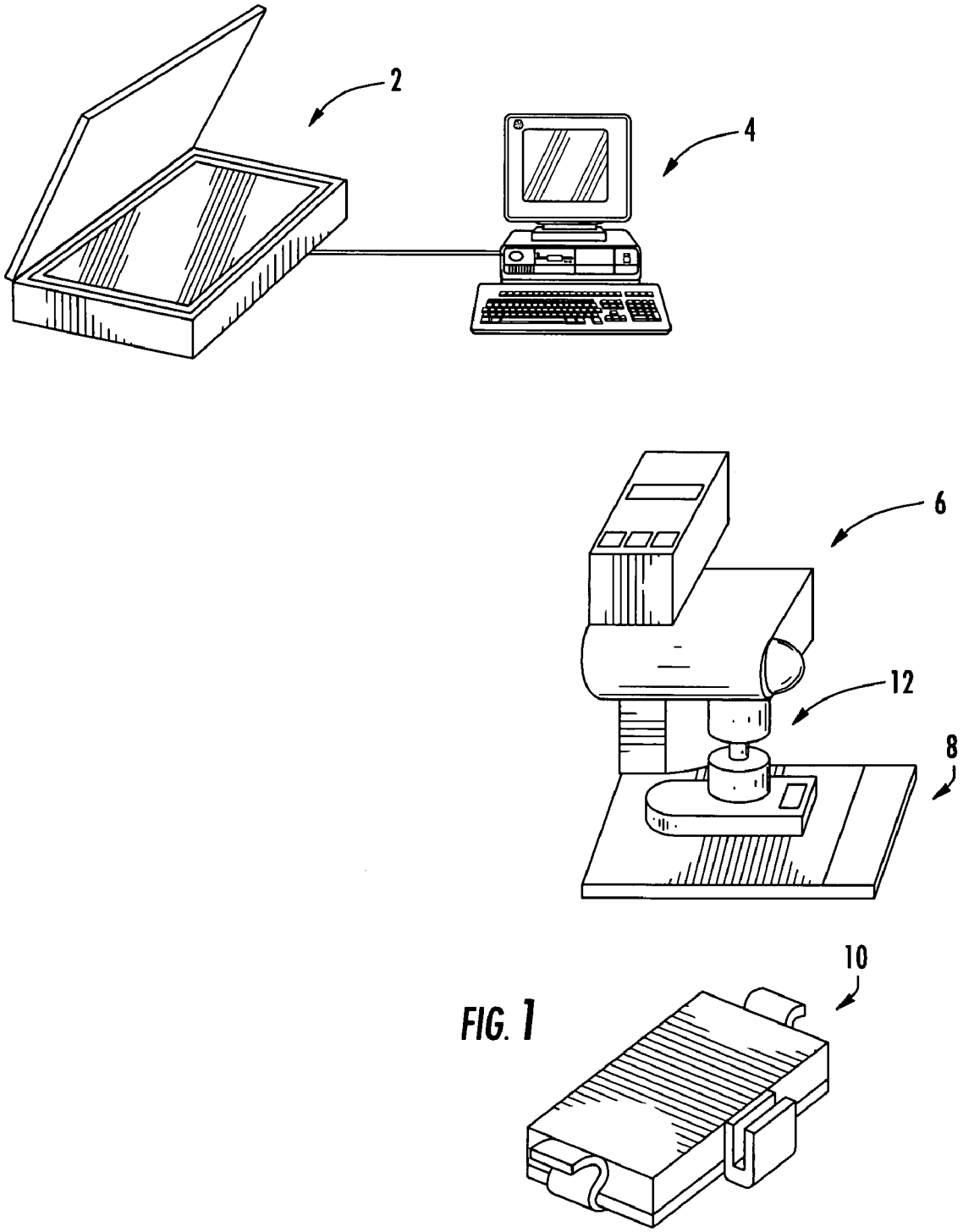
FIG. 1 is substantially a schematic view of the devices that may be used to execute the various embodiments of the print quality evaluation method of the present invention.

The present invention includes methods and devices for evaluating print quality. Referring to FIG. 1, the present invention may utilize a print quality evaluation system 4 configured to take measurements indicative of print quality, including print density. The print quality evaluation system 4 may include a computer with print quality evaluation software and a scanner 2 that is connected to the computer.

Samples to be evaluated for print quality may be scanned through the scanner, which may then allow the print quality evaluation system 4 to take at least print density readings of the samples. The print quality evaluation system 4 and scanner 2 may be obtained from ImageXpert, Inc. of Nashua, N.H. It is noted that conventional densitometers known in the art, which may not include scanners or computers, may be used in lieu of print quality evaluation system 4 and still fall within the scope of the invention.

The present invention may also utilize a mechanical rub tester 6, which allows multiple surfaces to be controllably rubbed against each other. The mechanical rub tester 6 may rub the two surfaces with consistent pressure, speed, duration, or frequency. The mechanical rub tester 6 may include a platform 8 where a first sample may be positioned and a weighted sample mount 10 where a second sample may be positioned. The weighted sample mount 10 may be attached to a motor 12 that provides the driving force for rubbing the first and second samples against each other. The rub conditions may be predefined. For instance, the motor 12 may be programmed to execute a predefined number of rub strokes at a predefined speed considering the weight of the block and sample attached to the motor 12. The mechanical rub tester 6 may be a rub tester by Sutherland, which may be purchased from Danilee Corporation of San Antonio, Tex. The print density readings of the samples may be taken before being rubbed using the mechanical rub tester 6 and after being rubbed.

Figure 2:
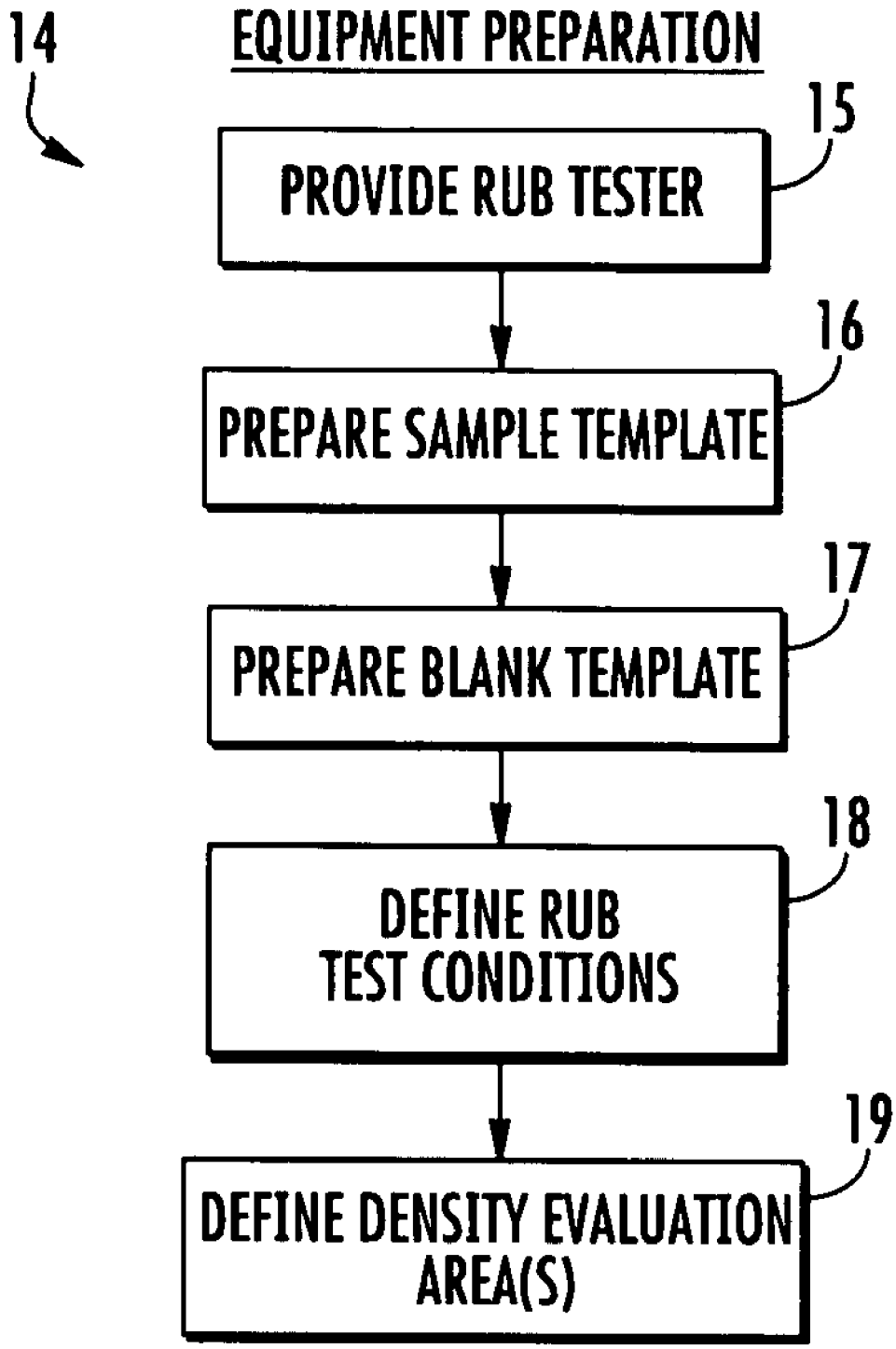
FIG. 2 is substantially a flowchart showing the preparatory steps for executing the various embodiments of the print quality evaluation method of the present invention.

The print quality evaluation method of the present invention preferably includes the following steps, which are shown in the equipment preparation flowchart 14 of FIG. 2. At step 15, a rub tester, such as the rub tester shown in FIG. 1 and described above, may be provided. A sample template may be prepared for use in sizing the sample to be evaluated (step 16). In the preferred embodiment, the sample template is a block of material, such as plastic or wood, having a length of approximately seven (7) inches and width of two (2) inches. It is noted that the dimensions of the sample template is dictated by the mechanical rub tester, and thus may vary depending on the mechanical rub tester being used. The dimensions given herein are for description purposes only and should not be regarded as limiting.

At step 17, a blank template may be prepared for use in sizing any blank paper that may be used during the print quality evaluation. The blank template may be of the same size and material as the sample template. The sample or the blank template may be used by laying it on the sample or blank paper, tracing the edges of the template, and cutting the sample or blank paper along the tracing. The sample or the blank template ensures that consistent sample or blank prints are used throughout the print quality evaluation.

Next, at step 18, the rub tester conditions are preferably pre-programmed. For instance, the rub tester may be pre-programmed to execute a predefined number of rub strokes at a certain speed considering the weight of the block attached to it. In the preferred embodiment, the predefined number of rub strokes is ten (10) for all samples and blank papers. It can be appreciated that the print quality evaluation method of the present invention provides a consistent and repeatable evaluation method, as the manner in which the samples and blank papers are rubbed are highly controlled by having consistent number of rub strokes and by using weighted sample mounts that have predefined weights.

Figure 3:
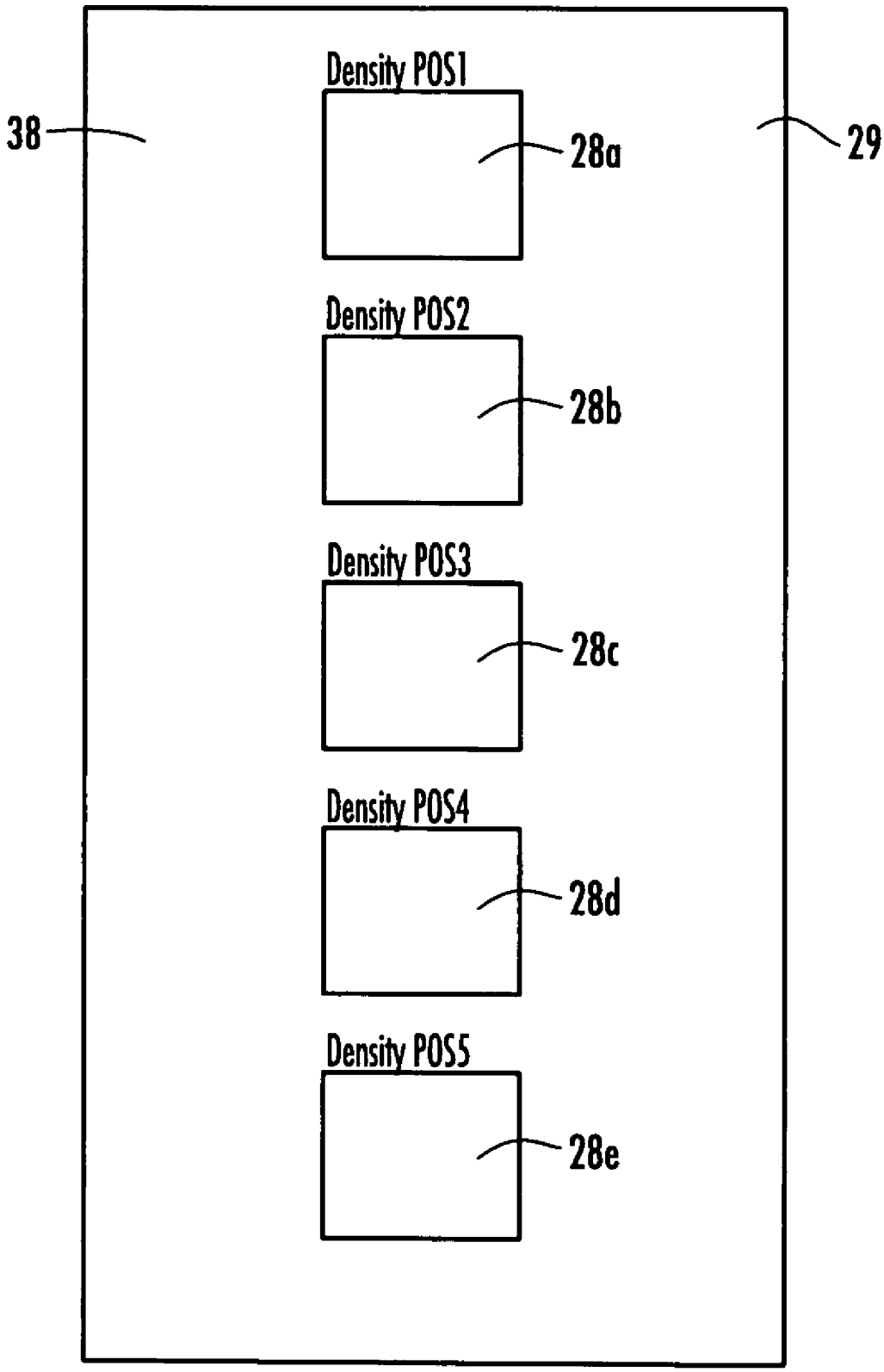
FIG. 3 is substantially a front view of a print sample showing the various density evaluation areas.

At step 19, one or more density evaluation areas are preferably defined. The density evaluation areas are the areas where the print quality evaluation system is configured to take print density readings. Referring to FIG. 3, in the preferred embodiment, five (5) density areas of 0.5 square inch dimension each (28*a-e*) are defined. The first density area 28*a* is preferably 1-1.7 inches from the top 29 of the sample or blank paper. 0.25 inch of distance preferably exists in between the density areas 28*a-e*. The density areas 28*a-e* are preferably positioned 0.6 inch from the left side 38 of the sample or blank paper. It is noted that the number, positions, and sizes of the density areas may be varied and still fall within the scope of the invention. The number, positions, and sizes of the density areas ensure that the print quality evaluation system consistently take readings at the same locations. It can further be appreciated that the predefined density evaluation areas allow the print quality evaluation method of the present invention to generate reliable results.

Figure 4:
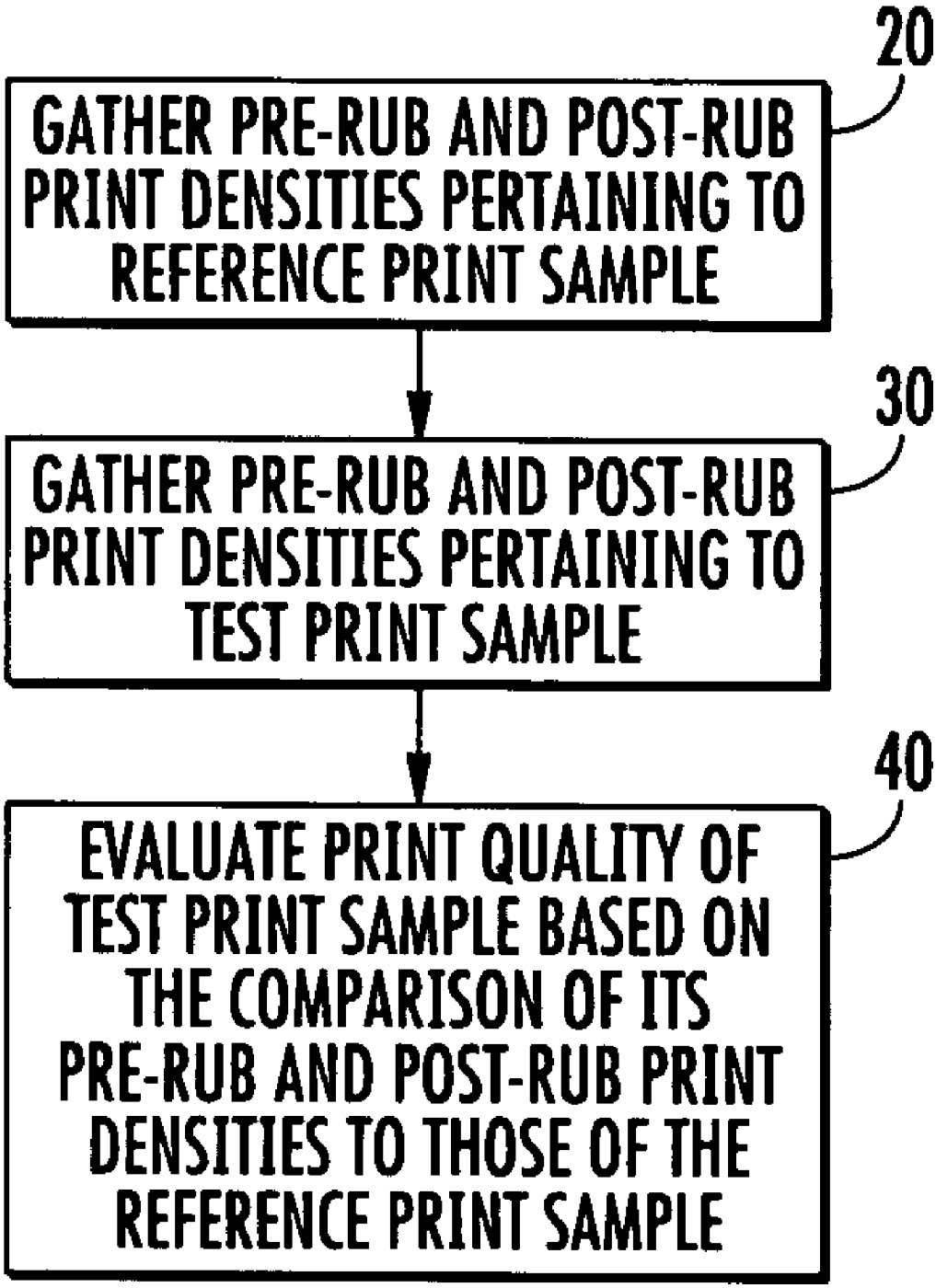
FIG. 4 is substantially a flowchart showing an embodiment of the print quality evaluation method of the present invention.

Referring now to FIG. 4, an embodiment of a method for evaluating print quality is shown wherein at step 20, pre-rub and post-rub print densities pertaining to a reference print sample may be gathered. As used herein, the term "pre-rub" is used to refer to the state of a sample or a material prior to being rubbed as described further below. The term "post-rub" is used to refer to the state of a sample or a material after being rubbed as described further below. The term "reference print sample" is used to refer to a print sample that is chosen to serve as a standard. For instance, a reference print sample may be a print sample generated by a printer that used an original equipment manufacturer's printer cartridge, printer cartridge part, or toner.

With continued reference to FIG. 4, at step 30, pre-rub and post-rub print densities pertaining to a test print sample may then be gathered. A test print sample may be a print sample generated by a printer that used a re-manufacturer's printer cartridge, aftermarket printer cartridge part, or aftermarket toner. The print quality of the test print sample may then be evaluated by comparing the pre-rub and post-rub densities pertaining to the test print sample with those that pertain to the reference print sample.

Figure 5:
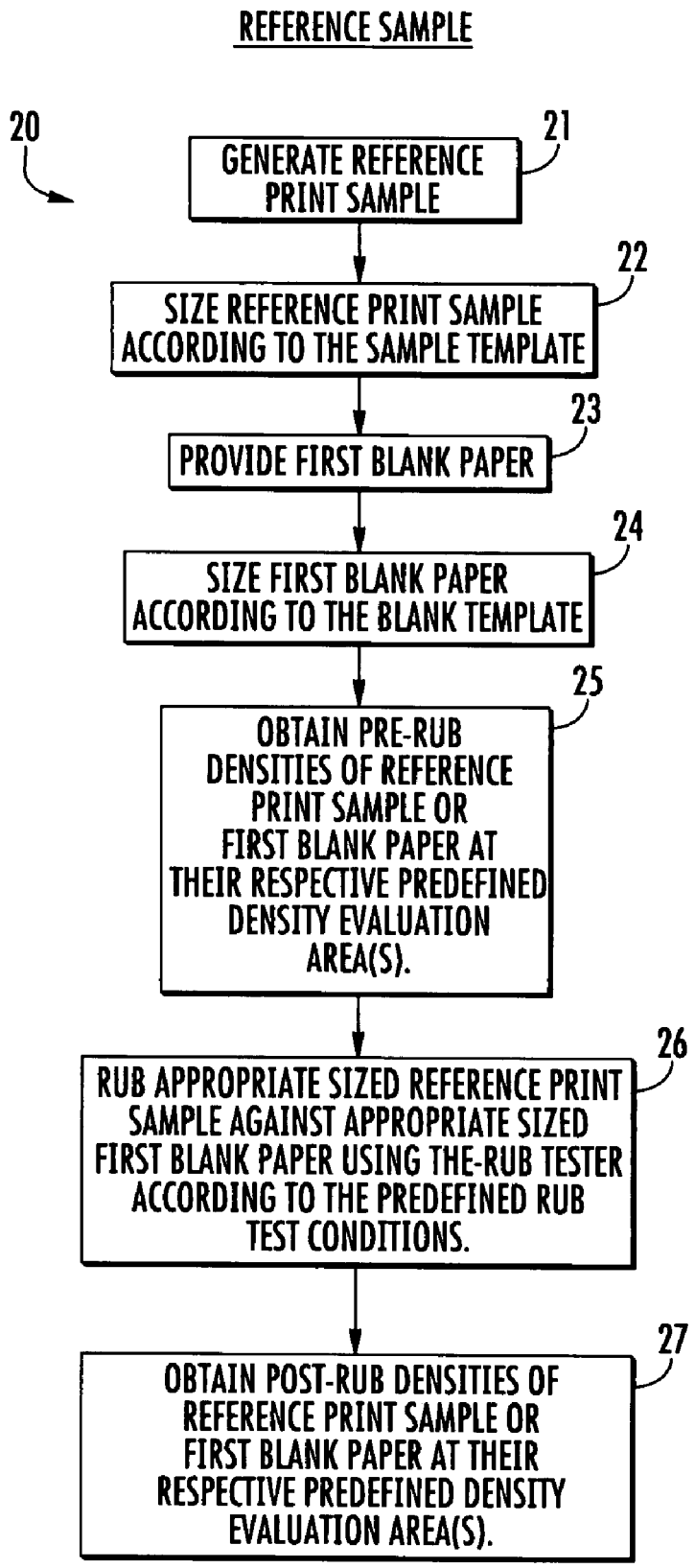
FIG. 5 is substantially a flowchart showing the steps for obtaining pre-rub and post-rub print densities pertaining to a reference print sample.

Referring now to FIG. 5, the detailed preferred embodiment of obtaining pre-rub and post-rub print densities pertaining to reference print sample (step 20) is shown wherein at step 21 one or more reference print samples are generated. Reference print samples with 100% fill and 30% fill may be generated, as desired. The terms 100% fill and 30% fill pertain to the relative darkness of image or print being formed on a piece of paper and are commonly well known in the art. Next, at step 22, the reference print samples are preferably sized according to the sample template, as discussed from FIG. 2. A first blank paper may then be provided (step 23) and sized according to the blank template, as discussed from FIG. 2 (step 24). The sized reference print sample and the sized first blank paper may then be scanned through the scanner 2, which will allow the print quality evaluation system 4 to take density readings at the predefined density evaluation areas discussed above (step 25). The density readings from step 25 are pre-rub print densities.

Next, using the rub tester 6, at step 26, the sized blank paper is preferably positioned on the weighted sample mount 10, which is then attached to the rub test motor 12. The sized reference print sample is preferably positioned on the platform 8 of the rub tester 6. The motor 12 may then be activated and allowed to execute the predefined number of rub strokes at a predefined speed discussed above. After the blank paper and the reference print sample are rubbed against each other, the blank paper and the reference print sample are preferably individually scanned through the scanner 2 to obtain the post-rub print density readings at the predefined density evaluation areas (step 27).

Figure 6:
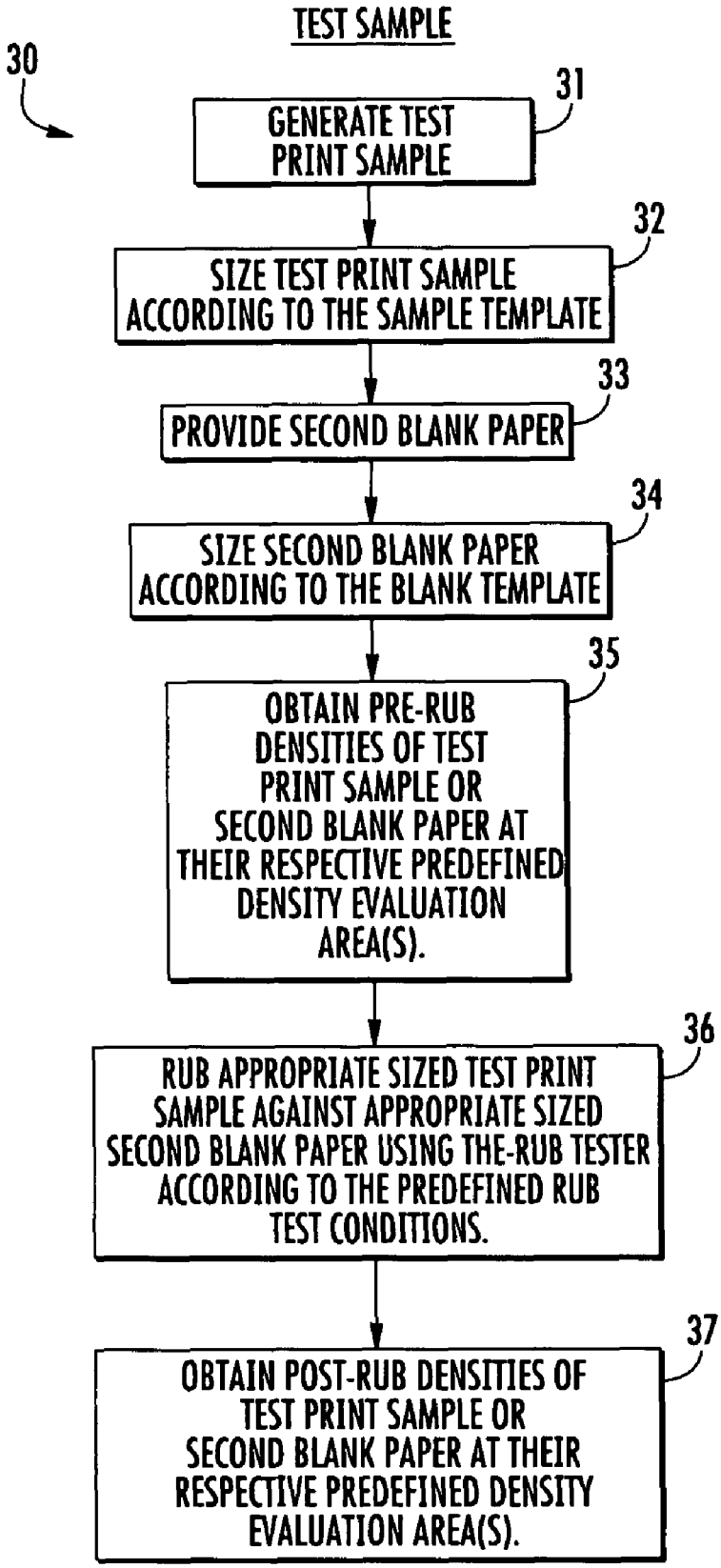
FIG. 6 is substantially a flowchart showing the steps for obtaining pre-rub and post-rub print densities pertaining to a test print sample.

The preferred process 30 of obtaining pre-rub and post-rub print densities pertaining to the test print samples will now be discussed using FIG. 6. At step 31, one or more test print samples are preferably generated. Again, test print samples of 100% fill and 30% fill are preferably generated. The test print samples are then preferably sized using the sample template discussed above (step 32). A second piece of blank paper is preferably provided (step 33) and sized using the blank template discussed above (step 33). The appropriately sized test print samples and second blank paper are preferably scanned individually through the scanner 2 to allow the print quality evaluation system 4 to take their individual print density measurements at their respective density evaluation areas (step 35). Each of the test print samples is preferably rubbed with one second blank paper using the rub tester 6 (step 36). The second blank paper is preferably attached to the weighted sample mount 10 and one test print sample is preferably positioned on the platform 8 of the rub tester 6. The rub tester 6 may then be activated to execute the predefined number of rub strokes at a predefined speed discussed above. After the second blank paper and the test print samples have been rubbed, each of them may be scanned through the scanner 2 to obtain post-rub print density measurements (step 37).

The gathered data may now be compiled and reported to a table 40 shown in FIG. 7. The first five columns 42*a*-42*e* preferably represent the predefined density evaluation areas. The last column represents the average density from all the density evaluation areas. The four rows 44*a-d* preferably represent the density readings for the pre-rubbed first blank paper, post-rubbed first blank paper, pre-rubbed second blank paper, and post-rubbed second blank paper, respectively. It is noted that the first blank paper provides a measure of toner fusability of the reference print sample, as it was rubbed with it. The second blank paper provides a measure of the toner fusability of the test print sample, as it was rubbed with it.

After the average print densities are calculated and reported in column 42*f*, the difference between the average post-rub density and the average pre-rub density may be calculated for the each of the first blank paper and the second blank paper. The differences are preferably reported in rows 46*a* and 46*b*. The differences can be expressed as a percentage of their respective average post-rub densities as shown in rows 48*a* and 48*b*. Portion 50 of table 40 indicates the difference in terms of toner fusability between a reference print sample and a test print sample. In the example shown, the toner fusability of the reference print sample and the test print sample only varies by 5%. A manufacturer or re-manufacturer may choose to accept or reject the cartridge part, cartridge, or toner used in generating the test print sample, depending on the criteria set. For instance, the re-manufacturer may set a criteria rejecting products having print density variance of over 5% against the OEM products.

The table 50 of FIG. 8 shows another way to view the results from the print quality evaluation method of the present invention. Table 50 has all the features of table 40, except that it considers print densities taken from the actual reference print sample or test print sample rather than the blank papers. Thus, it can be appreciated that print densities pertaining to a reference print sample can be obtained by looking at the pre-rub and post-rub data of either the actual reference print sample or the blank paper that was rubbed against it. It can also be appreciated that print densities pertaining to a test print sample can be obtained by looking at the pre-rub and post-rub data of either the actual test print sample or the blank paper that was rubbed against it.

It can now be realized that the present invention provides a print quality evaluation method that would generate reliable and repeatable results. It can further be realized that the present invention also provides a print quality evaluation method that allows re-manufacturers to effectively compare their products' performance against those of the original equipment manufacturers. The print quality evaluation method allows re-manufacturers to set standards and implement a protocol to review their products' compliance with the standards. Finally, the present invention provides a much more efficient alternative to conventional methods of using adhesive tapes or fingers.

Although the description above contains many specifications, these should not be construed as limiting the scope of the invention but as merely providing illustrations of some of the presently preferred embodiments of this invention. For example, the number and the sizes of the density evaluation areas may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A method for evaluating toner print quality for print quality features comprising density and fusability, the method comprising:

a. providing a first blank page;

b. generating at least one reference print sample;

c. defining at least one density and fusability evaluation area;

d. generating a first set of data by determining print density of the first blank page and by determining print density and fusability of the reference print sample at each of their respective density and fusability evaluation areas;

e. providing a mechanical rub tester;

f. rubbing the reference print sample against the first blank page using the mechanical rub tester;

g. generating a second set of data by determining print densities and fusabilities of rubbed first blank page and rubbed reference print sample at each of their respective density and fusability evaluation areas;

h. providing a second blank page;

i. generating at least one test print sample;

j. generating a third set of data by determining print density of the second blank page and by determining print density and fusability of the test print sample at each of their respective density and fusability evaluation areas;

k. rubbing the test print sample against the second blank page using the mechanical rub tester;

l. generating a fourth set of data by determining print densities and fusabilities of rubbed second blank page and rubbed test print sample at each of their respective density and fusability evaluation areas; and m. comparing the first and third sets of data or second and fourth sets of data, wherein after the first blank page and the reference print sample are rubbed against each other, each of them are scanned through a scanner connected to a computer having print quality evaluation software to obtain post-rub print density readings, and wherein after the second blank page and the test print sample are rubbed against each other, each of them are scanned through the scanner connected to the computer having the print quality evaluation software to obtain post-rub print density readings.

2. The method of claim 1, wherein the reference print sample is a print sample generated by using toner from an original equipment manufacturer.

3. The method of claim 2, wherein the test print sample is a print sample generated by using aftermarket toner.

4. The method of claim 1, wherein the reference print sample is a print sample generated by using a printer cartridge from an original equipment manufacturer.

5. The method of claim 2, wherein the test print sample is a print sample generated by using a remanufactured printer cartridge.

6. The method of claim 1, wherein the comparing step comprises:

a. taking first average print density for the first blank page from the first data set;

b. taking second average print density and fusability for the rubbed first blank page from the second data set;

c. subtracting the first average print density from the second average print density to obtain a first density difference;

d. taking third average print density for the second blank page from the third data set;

e. taking fourth average print density and fusability for the rubbed second blank page from the fourth data set;

f. subtracting the third average print density from the fourth average print density to obtain a second density difference; and g. comparing the reference print sample and the test print sample by comparing the first and second density difference and by comparing fusability between the reference print sample and the test print sample.

7. The method of claim 1, wherein the comparing step comprises:

a. taking first average print density and fusability for the reference print sample from the first data set;

b. taking second average print density and fusability for the rubbed reference print sample from the second data set;

c. subtracting the first average print density and fusability from the second average print density and fusability to obtain a first density difference and a first fusability difference;

d. taking third average print density and fusability for the test print sample from the third data set;

e. taking fourth average print density and fusability for the rubbed test print sample from the fourth data set;

f. subtracting the third average print density and fusability from the fourth average print density and fusability to obtain a second density difference and a second fusability difference; and g. comparing the reference print sample and the test print sample by comparing the first and second density difference and by comparing the first and second fusability difference.

8. The method of claim 1, further comprising providing a densitomer.

9. The method of claim 1, further comprising defining a predefined number of rub stroke of about ten (10) rub strokes for the mechanical rub tester to execute.

10. A method for evaluating toner print quality for print quality features comprising density and fusability, the method comprising:

a. providing a reference print sample;

b. providing a test print sample;

c. obtaining pre-rub densities of the reference and the test print samples;

d. providing a mechanical rub tester;

e. rubbing the reference print sample with a first paper using the mechanical rub tester;

f. obtaining post-rub density and fusability of rubbed reference print sample;

g. rubbing the test print sample with a second paper using the mechanical rub tester;

h. obtaining post-rub density and fusability of rubbed test print sample; and i. comparing the pre-rub and post-rub densities and fusabilities of the reference print sample and the rubbed test print sample, wherein after the reference print sample is rubbed with the first paper, each of them are scanned through a scanner connected to a computer having print quality evaluation software to obtain post-rub print density readings, and wherein after the test print sample is rubbed with the second paper, each of them are scanned through the scanner connected to the computer having the print quality evaluation software to obtain post-rub print density readings.

11. The method of claim 10 further comprising defining at least one common density and fusability evaluation area and obtaining post-rub density and fusability readings of the first paper, second paper, reference print sample, and test print sample from the common density and fusability evaluation area.

12. The method of claim 10 further comprising providing a densitometer that takes density readings via the scanner.

13. The method of claim 10 further comprising rubbing the test print sample and the second paper with about ten (10) rub strokes with the mechanical rub tester.

14. The method of claim 10 further comprising rubbing the reference print sample and the first paper with about ten (10) rub strokes with the mechanical rub tester.

15. A method for evaluating toner print quality for print quality features comprising density and fusability, the method comprising:

a. providing a first paper;

b. providing a second paper;

c. providing a reference print sample;

d. providing a test print sample;

e. obtaining pre-rub densities of the first paper, the second paper, the reference print sample, and the test print samples;

f. providing a mechanical rub tester;

g. rubbing the reference print sample with a first paper using the mechanical rub tester;

h. obtaining post-rub density and fusability of rubbed first paper;

i. rubbing the test print sample with a second paper using the mechanical rub tester;

j. obtaining post-rub density and fusability of rubbed second paper; and k. comparing the pre-rub and post-rub densities and fusabilities of the first and second papers, wherein after the reference print sample is rubbed with the first paper, each of them are scanned through a scanner connected to a computer having print quality evaluation software to obtain post-rub print density readings, and wherein after the test print sample is rubbed with the second paper, each of them are scanned through the scanner connected to the computer having the print quality evaluation software to obtain post-rub print density readings.

16. The method of claim 15 wherein the reference print sample utilizes toner from an original equipment manufacturer.

17. The method of claim 15 wherein the test print sample utilizes aftermarket toner.

18. The method of claim 15 wherein the reference print sample utilizes a printer cartridge from an original equipment manufacturer.

19. The method of claim 15 wherein the test print sample utilizes a remanufactured printer cartridge.

* * * * *